US006199401B1

(12) United States Patent
Haussmann

(10) Patent No.: US 6,199,401 B1
(45) Date of Patent: Mar. 13, 2001

(54) DISTRIBUTING/COLLECTING TANK FOR THE AT LEAST DUAL FLOW EVAPORATOR OF A MOTOR VEHICLE AIR CONDITIONING SYSTEM

(75) Inventor: Roland Haussmann, Wiesloch (DE)

(73) Assignee: Valeo Klimatechnik GmbH & Co., KG, Hockenheim (DE)

( * ) Notice: Subject to any disclaimer, the term of this patent is extended or adjusted under 35 U.S.C. 154(b) by 0 days.

(21) Appl. No.: 09/214,502

(22) PCT Filed: May 5, 1998

(86) PCT No.: PCT/EP98/02633

§ 371 Date: Jan. 6, 1999

§ 102(e) Date: Jan. 6, 1999

(87) PCT Pub. No.: WO98/50740

PCT Pub. Date: Nov. 12, 1998

(30) Foreign Application Priority Data

May 7, 1997 (DE) ..... 197 19 251

(51) Int. Cl.[7] ..... F25B 39/02

(52) U.S. Cl. ..... 62/525; 62/527; 165/153; 165/174; 165/DIG. 466

(58) Field of Search ..... 62/525, 524, 527; 165/174, 153, DIG. 465, DIG. 466, DIG. 483

(56) References Cited

U.S. PATENT DOCUMENTS 2,044,455 * 6/1936 Witzell ..... 62/126
2,099,186 * 11/1937 Anderegg ..... 257/248
3,976,128 * 8/1976 Patel ..... 165/153
4,458,750 * 7/1984 Huber ..... 165/174
5,111,878 * 5/1992 Kadle ..... 165/176
5,651,268 * 7/1997 Aikawa et al. ..... 62/525
5,701,760 * 12/1997 Torigoe et al. ..... 62/524
5,901,785 * 5/1999 Chiba et al. ..... 165/174

FOREIGN PATENT DOCUMENTS

WO 94-14021 * 6/1994 (AU) .
9420-659 * 2/1995 (DE) .
0-029-859 * 8/1989 (EP) .
3083-599 * 8/1989 (EP) .
0-683-373 * 11/1995 (EP) .

* cited by examiner

*Primary Examiner*—Corrine McDermott
*Assistant Examiner*—Marc Norman
(74) *Attorney, Agent, or Firm*—Morgan & Finnegan LLP

(57) ABSTRACT

The invention relates to a distributing/collecting tank (distributor/header case) of aluminum or an aluminum alloy of an at least dual flow (double-flow) brazed evaporator of a motor vehicle air conditioning equipment, wherein the case comprises a tube bottom and a cap (28), which supplement each other at least in the direction of the narrow cross-section to the case, and in its longitudinal extension direction corresponding to the number of flows at least a longitudinal partition, wherein at least one case wall on the front side is formed by a separate end piece (62) being in close contact to each adjacent longitudinal partition and at least one case wall is provided with the refrigerant inlet (14). According to the invention, it is provided that an injection valve (50) for the refrigerant is attached to the end piece (62) provided with the refrigerant inlet (14) by means of a plug-type connection or flange connection (48), an injection valve is at least partially integrated in the design of the end piece (62) and/or at least one end piece (62) together with a projecting piece (90) leaves open a connection room (104) on the side facing away from the heat exchange tubes (2) in elongation on the front side of the room occupied by the heat exchange tubes (2) of the evaporator.

22 Claims, 3 Drawing Sheets

DISTRIBUTING/COLLECTING TANK FOR THE AT LEAST DUAL FLOW EVAPORATOR OF A MOTOR VEHICLE AIR CONDITIONING SYSTEM

BACKGROUND OF THE INVENTION

The invention relates to a distributing/collecting case (or tank or header) of aluminum or an aluminum alloy of an at least double-flow brazed evaporator of a motor vehicle air conditioning equipment with the features of the preamble of claim 1. Such a case is known from the DE-C1-195 15 526 (in particular FIG. 4).

The term distributing/collecting case is to include the three application possibilities of a case (or tank or header), namely either, in case of an even number of the flows, to be provided only at one respective end of the heat exchange tubes of the evaporator with an inlet and an outlet function, or, in case of an uneven number of flows, to concern the case on the inlet and/or on the outlet side, and finally in both mentioned cases to be able to accomplish an additional distribution function to individual heat exchange tubes or groups thereof as a case on the inlet side.

Moreover, the invention concerns especially the design of such a case in a multipart embodiment with a bottom and a cap, which, however, in contrast to the otherwise usual construction, are terminated by at least one separate end piece at least on one front side. In this case, the refrigerant inlet is provided at at least one case wall, in the mentioned known case at the cap of the case.

The design of at least one separate end piece offers a greater liberty concerning the design and in particular the manufacture of tube bottom and cap from a solder-coated or braze-coated sheet metal of aluminum or an aluminum alloy, if the tube bottom and the cap have a constant external cross-section between the case walls on the front side in the longitudinal extension direction and thus also have a constant external cross-section of the case in the longitudinal extension direction, one can carry out the prefabrication of tube bottom and cap invariantly with respect to the case length by cutting off sections from the prefabricated longitudinal profiles of cap and tube bottom, as required. This is already interesting if during prefabrication a case wall for the front side is additionally prefabricated, as then the cutting off can be effected at the other end. Of particular interest and particularly material-saving is a prefabrication as an endless billet made by an arbitrary fabrication technology, the parts of which are supplemented by end pieces at both front sides, no matter how long the parts are. This is not only true for a continuous extrusion but in particular for other continuous designs of an undefined length, as they e.g result from rolling sheet metal parts, which is preferred in connection with the invention. This particularly enables the processing of sheet metals precoated with solder or braze.

SUMMARY OF THE INVENTION

The object underlying the invention is to further improve the design of a distributor/header case of the mentioned type of construction with respect to manufacture and function.

This object is solved in a case with the features of the preamble of claim 1 by the characterizing features thereof.

The end piece which is in this case only necessary at one front side of the case is now a multi-function piece having the following functions:

- it is the only end piece on the front side in contrast to the mentioned prior art of the DE-C1-195 15 526, where at one front side of the case several end pieces are provided;
- feeding the refrigerant inlet as well as the refrigerant outlet through this one end piece on the front side;
- further development as link (or joining piece or connecting piece) for the two lines extending externally and optionally also for one line continued internally, the latter in case of an injection pipe projecting to the inside, which can serve as a direct injection pipe;
- as a result saving separate connection means.

If the refrigerant is not distributed to the individual heat exchange tubes within a case on the inlet side by means of correspondingly dimensioned throttles in the course of a so-called direct injection (cf. DE-A1-195 15 527, in particular FIGS. 6 and 7), conventionally a separate injection valve, now conventionally designed as a thermostatically controlled block valve, is connected to the refrigerant inlet of the case on the inlet side of an evaporator via a supply line. Such a supply line, however, requires its own material and space, has to be separately manufactured and stocked up and causes segregation effects between the liquid and the gaseous phase of the refrigerant supplied to the evaporator, if the distance between the injection valve and the case is relatively long or the supply line even has a bent course, which generally reduces the efficiency and, in particular if the case further comprises a distributor means of the refrigerant to individual heat exchange tubes or groups thereof, causes distribution disturbances with respect to the desired optimal refrigerant allocation with a constant proportion of liquid and gaseous phase.

These functional difficulties are eliminated according to the solution of the invention according to claim 1.

Claim 1 provides a direct connection of the injection valve to the end piece, which is so direct that no segregation difficulties of the kind mentioned above arise anymore. Here, commercially available injection valves and conventional types of connection thereof can be applied.

Moreover, the manufacture and the design by combining longitudinal profiles cut at an arbitrary length and being made according to an arbitrary manufacture technology is rendered easier with the prefabricated multifunctional end piece applicable for various lengths.

Here, furthermore a thermostatically controlled block valve (cf. claim 2) can control the operation of the evaporator, measuring the temperature and in most cases also the pressure of the refrigerant exiting the evaporator, as the refrigerant inlet as well as the refrigerant outlet extend through the same end piece.

As already mentioned, the supply lines to the refrigerant inlet of the evaporator require their own space, which is critical in particular in motor vehicle air conditioning equipment. The solution according to the invention in accordance with claim 4 at least partially saves a separate assembly space for the supply line. This space-saving effect can also be extended to an injection valve inserted in front of the evaporator in the sense of claim 5. In particular by this measure, furthermore the advantageous combination possibility of the idea of the invention according to claim 6 with the idea of the invention according to claims 1 or 2 becomes clear.

The further subclaims concern preferred further designs of the embodiment according to claim 4. Here, the claims 12 and 13 concern products of manufacturing techniques for the end pieces, which have not been common in the past in this context. The design of the end piece as diecast or injection moulded piece according to claims 14 and 15 with an integrated inclusion of a chamber subdivision of the case and preferably also of distribution ducts consequently continues the integration idea according to claim 4.

It is just when the end piece according to claim 12 is an extruded part or according to claim 13 is designed as diecast or injection moulded piece (used as synonyms within the scope of the invention), that in a preferred manner the tube bottom and/or cap can be continued to be shaped of solder-coated or braze-coated sheet metal in the conventional manner, wherein in case of the material aluminum or aluminum alloy employed herein, the braze only has to be applied to the precoated sheet metal.

BRIEF DESCRIPTION OF THE DRAWINGS

In the following, the invention will be illustrated more in detail by means of schematic drawings and several embodiments, wherein.

DETAILED DESCRIPTION OF DRAWINGS

Figure 1:
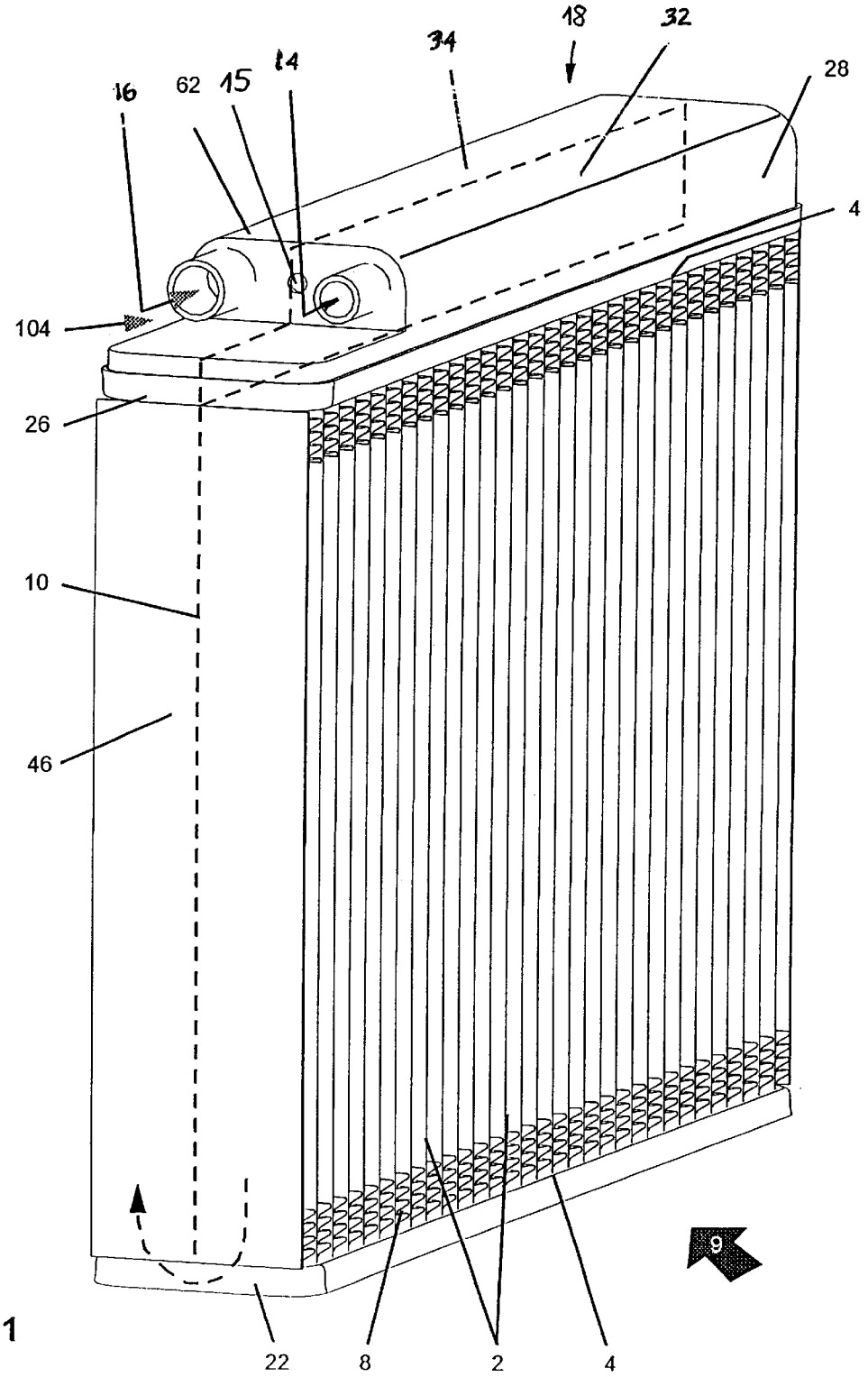
FIG. 1 shows a perspective view from the outside of an upright double-flow flat tube heat exchanger designed as an evaporator with a first embodiment of a case according to the invention.

The five embodiments of distributing/collecting cases (or tank or header) 18, shortly named cases in the following, represented in the five figures are referred each to flat tube heat exchangers of the refrigerant circulation of a motor vehicle air conditioning equipment, in effect in FIGS. 1 to 4 in a double-flow design and in FIG. 5 in a four-flow design.

This does not exclude to transfer the gist of the represented features also to cases of evaporators with a different number of flows, optionally also to those evaporators which are not designed with flat tubes.

The flat tube heat exchanger has the following general design:

A major number of typically twenty to thirty flat tubes 2 is arranged at constant distances to each other and with aligned front sides 4. Between the flat sides 6 of the flat tubes, a zig zag fin 8 each is internested in a sandwich fashion. A zig zag fin 8 each is furthermore arranged at the two outer surfaces of the outer flat tubes. Each flat tube comprises internal reinforcing webs, which division off chambers 12 in the flat tube acting as continuous ducts. Depending on the structural depth, a number of the chambers or ducts 12 of ten to thirty is typical.

The stated typical regions of the number of flat tubes and the chambers thereof is intended to be only a preferred number and is not intended to be restricting.

In a motor vehicle air conditioning equipment, in the final state outer air as an external heat exchange medium flows in the direction of arrow 9 shown in FIG. 1 in the direction of the structural depth through the block arrangement of the flat tubes 2 and the zig zag fins 8.

In the evaporator, a refrigerant, such as in particular fluorohydrocarbon, serves as internal heat exchange medium which enters the heat exchanger via a supply line 14 and exits the heat exchanger via an outlet line 16. In the refrigerant circulation, the supply line comes from the liquefier thereof. The outlet line 16 leads to the condenser of the refrigerant circulation.

In an evaporator, the distribution of the refrigerant on the inlet side is conveniently effected from the supply line 14 to the individual flat tubes by a so-called distributor. On the outlet side, the refrigerant is supplied as a whole to the outlet line 16. Though it is possible to assign the distribution and the collection to separate boxes or tanks, in all embodiments both functions are combined in a common case or tank or header 18.

This header 18 is then arranged at a front side 4 of the flat tubes 2, while at the other front side 4 of the flat tubes 2, a flow reverse takes place only between each of the flows, here for example in a common reversion header 22 according to FIG. 1. In the double-flow embodiment according to FIG. 1, the two flows are separated from one another by a reinforcing web 10 of the respective flat tube 2 between adjacent chambers 12 which are admitted by the internal heat exchange fluid in opposite directions.

In the borderline case of a one-flow heat exchanger, the reversion header 22 would be replaced by an outlet header which is not shown.

The multi-flow design means at least one flow reverse in the region of the individual ducts formed by the chambers 12 in each flat tube 2. In a double-flow design, the reversion header 22 does then not need any further intermediate chamber subdivision, it is only necessary that the single reversion function is guaranteed. In case of a reversion with more than two flows, at least one parting wall each is needed in the reversion header, so that in case of a four-flow design, a double simple reversion is effected in the respective reversion header 22. In a design with an even greater number of flows, the number of parting walls optionally has to be further increased.

Without restricting the generality, in the preferred embodiments the case 18 is basically composed of a tube bottom 26 and a cap 28 in the peripheral direction, wherein optionally further parts can be provided in the peripheral direction for assembling the case 18.

Figure 2:
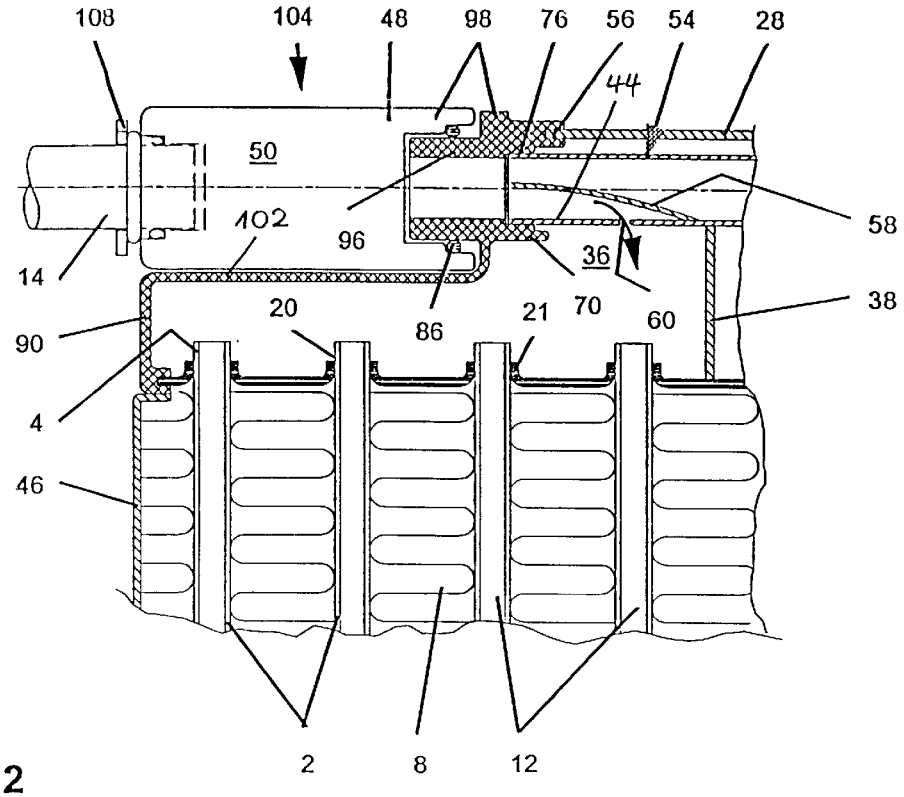
FIG. 2 shows a partial cross-section of a second embodiment of the case according to the invention in a vertical plane through the longitudinal axis of the case.
Figure 3:
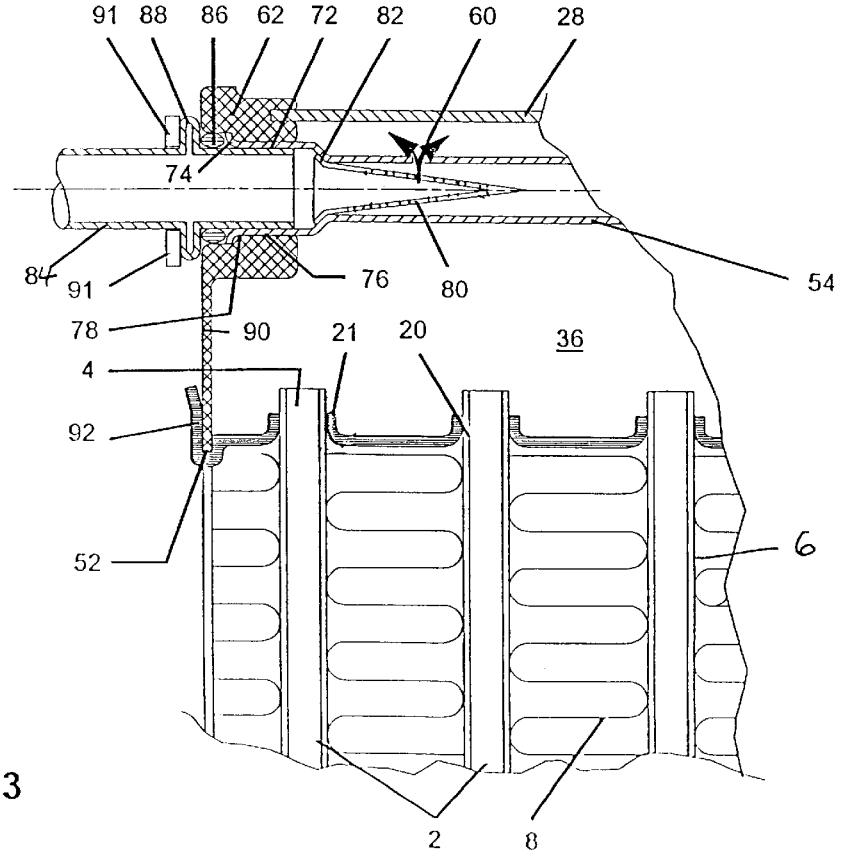
FIG. 3 shows a partial cross-section corresponding to FIG. 2, however with a third embodiment of the case according to the invention.

The free ends of the flat tubes 2 facing away from the reversion header 22 tightly engage the tube bottom 26 in communication with the inner space of the case 18, which tube bottom is correspondingly provided with engaging slits 20 as well as with corresponding internal engaging muffs 21 and/or external engaging muffs according to FIGS. 2 and 3.

As in the case 18 the inlet function and the outlet function of the refrigerant are combined, the case 18 requires at least a two-chamber design which separates an inlet side from the outlet side. For this purpose, the chamber subdivision generally denoted with 30 comprises at least one flat web in form of a longitudinal web 32, which separates the inlet region in the case 18 communicating with the supply line 14 from an outlet chamber 34 continuously extending longitudinally of the case 18 and communicating with the outlet line 16. The case or tank 18 is also named header or collector.

In an evaporator, furthermore the supply of the refrigerant on the side of the inlet to all flat tubes 2 has to be as uniform as possible. In a borderline case, the supplied refrigerant can be supplied to each individual flat tube 2 by a so-called distributor. In most cases, however, the supply is effected to adjacent groups of flat tubes 2, in which at least some groups comprise a number of flat tubes higher than one, wherein the number of flat tubes 2 per group can also vary. An inlet chamber 36 is assigned to each group of flat tubes, which chamber directly communicates with the respective group of the flat tubes. The inlet chambers 36 are divisioned off from one another in the chamber subdivision 30 by crosswise webs 38 designed as flat webs.

In the double-flow evaporator, the crosswise webs 38 depart at a right angle only from one side of the longitudinal web 32.

Figure 5:
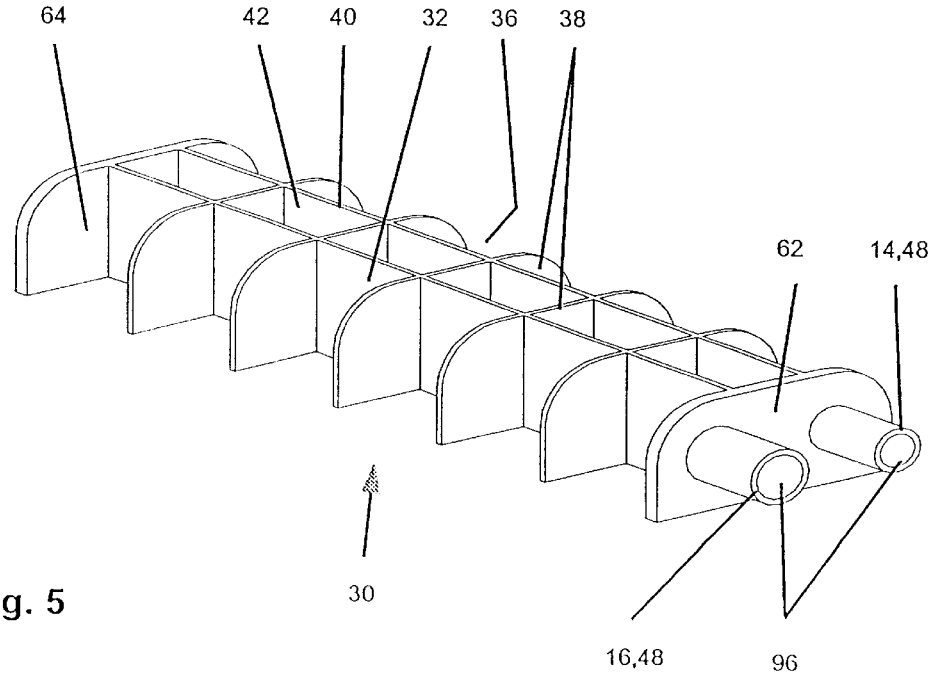
FIG. 5 shows a view of a possible compartment subdivision of a four-flow case made of diecast according to the invention as a fifth embodiment, which can be inserted integrally with an end piece on the front side of the case between the tube bottom and the cap thereof.

In the chamber subdivision of the case of a four-flow evaporator presupposed in FIG. 5, apart from the longitudinal web 32 contiguous to the outlet chamber 34, another longitudinal web 40 in parallel to this web is provided. This web is intersected at a right angle by the crosswise webs divisioning off the inlet chambers 36 up to the connection to the longitudinal web 32. In the elongation of the crosswise webs 38 between the two longitudinal webs 32 and 40, between each of these longitudinal webs an inner reversion chamber 42 contiguous to the respective outer inlet chamber 36 for reversing the second flow into the third flow is divisioned off within the header 18.

In case of greater numbers of flows which are lead through the header 18 with a reversion function, the number of the longitudinal webs with the function of the longitudinal web 40 as well as the number of the inner reversion chambers 42 increase correspondingly, the reversion chambers then being furthermore internested in the crosswise direction of the header each situated internally and one next to the other between the inlet chambers 36 as well as the outlet chamber 34.

The supply line 14 communicates with the individual inlet chambers 36 each via an own supply line 44 extending in the case 18, which is variously designed in the embodiments.

In most cases, in the final heat exchanger the block of flat tubes 2 and zig zag fins 8 is laterally terminated by a side sheet metal 46 in contact with each of the outer zig zag fins 8, such that the side sheet metals 46 form an outer frame for the outer air flowing to the heat exchanger block.

The flat tubes 2, the zig zag fins 8, the tube bottom 26 and the cap 28 of the case 18 together with the optionally provided chamber subdivision 30 as well as the side sheet metals 46 of the heat exchanger consist, as well as conveniently the supply line 14 and the outlet line 16, of aluminum and/or an aluminum alloy and are brazed including the adjacent sections of the line connections in the evaporator to form the final evaporator.

Without the invention being restricted thereto, in practice at least in refrigerant evaporators for motor vehicle air conditioning equipment, according to FIG. 1 the supply line 14 and the outlet line 16, which can pass over into the case 18 via corresponding connection sleeves, are connected to two respective connection sleeves 48 of a thermostatically controlled block valve 50 (cf. FIG. 2). At the opposite side, this valve comprises two further connection sleeves on the side of the inlet and of the outlet.

In the following, the various embodiments are considered more in detail:

In the embodiments of FIGS. 1 to 5, the tube bottom 26 and at least the major part of the cap 28 are formed of sheet metal pre-coated with solder or braze. The free edge of the cap here engages with an overlap on at least one side—in FIG. 3 an overlap 52 on two sides is represented—the tube bottom 26.

As can be seen more in detail from FIG. 5, the chamber subdivision 30 in the four-flow evaporators of FIG. 5 consists of the two longitudinal webs 32 and 40 as well as the crosswise webs 38 intersecting them. In case of FIG. 5, the whole chamber subdivision furthermore consists of an integral diecast or injection moulded piece, respectively, the terms diecast and injection moulded being understood as synonyms within the scope of the invention. This diecast piece is inserted in case of FIG. 5 between the cap 28 and tube bottom 26 shaped of sheet metal.

The expression intersecting flat webs of the chamber subdivision 30 also means the borderline case of an intersection on only one side in the sense of the only one-sided connection of the crosswise webs 38 to the longitudinal web 32 at a right angle, which is the complete chamber subdivision 30 in the case of the double-flow evaporator of FIGS. 1 to 4.

As can be seen from FIG. 2 at least indirectly, the case 18 has two levels seen in the extension direction of the flat tubes 2. In the lower level, all mentioned inlet chambers 36 into the groups of flat tubes 2 are arranged. In the upper level, additionally the own supply lines 44 extend to the chambers 36. The design of both levels is even easily possible in an integral diecast piece of the cap 28, as in the diecast piece the inlet chambers 36 are open on the side of the cap facing the tube bottom 26, and the own supply lines 44 to the inlet chambers 36 are open on the side facing away from the flat tubes 2 and are separated from the inlet chambers 36 only by a parting wall separating the two levels, in each of which outlet openings 60 from the own supply lines 44 into the respectively related inlet chamber 36 are arranged. The own supply lines 44 of the inlet chambers 36 are commonly fed by the refrigerant on the inlet side via the supply line 14 in the upstream direction and terminated each at their ends. Starting from the supply line 14, which is arranged at the front side of the case 18, the individual flow strings on the inlet side are distributed equally to the own supply lines 44 at the internal end of the supply line 14. The inlet cross-sections can be here adapted to the requirements of the evaporators, as required. All outlet openings 60 are arranged in a line which defines the incoming flow direction into the respectively related own inlet chamber 36.

The own supply lines 44 of the inlet chambers 36 together with the outlet openings 60 connecting these chambers could be in addition also integrally shaped in the diecast piece according to FIG. 5 destined as insertion piece between cap and tube bottom. Alternatively, however, an own manifold 54 for distributing the internal heat exchange fluid on the inlet side to the individual inlet chambers 36 can be provided, as is represented in FIGS. 2 to 4.

This manifold communicating on the inlet side with the supply line 14 comprises a tube casing 56 terminated at its other end on the front side, in which an outlet opening 60 is designed each to the individual own inlet chambers to the respective group of—in this case four—flat tubes. In the manifold 54, too, the outlet openings 60 extend longitudinally of a straight line. For illustrating possible different orientations of the outlet openings 60 with respect to the inlet cross-sections of the flat tubes 2, in FIGS. 2 and 4 each an orientation of the outlet openings 60 in direction to the tube bottom 26, but not directly to the opening of a flat tube, which is also possible, are represented. As a possible alternative, FIG. 3 shows the orientation of the respective outlet opening 60 into the inlet chamber 36 in direction to the cap 28 of the case.

In FIG. 2, it is furthermore indicated at 58, that in the manifold 54 of the corresponding second embodiment, the tube casing 56 has a star-shaped subdivision, which separates own supply lines 44 in the tube casing 56 of the manifold 54 helically continued in the manifold, wherein one of the outlet openings 60 each to the respective inlet chamber 36 is connected to these own supply lines 44. Though the cross-section of the outlet openings can be in this case as well as in all other embodiments adapted for injection purposes, in this fourth embodiment the dosed supply of the internal heat exchange fluid is primarily effected via the already mentioned thermostatically controlled block valve 50.

Figure 4:
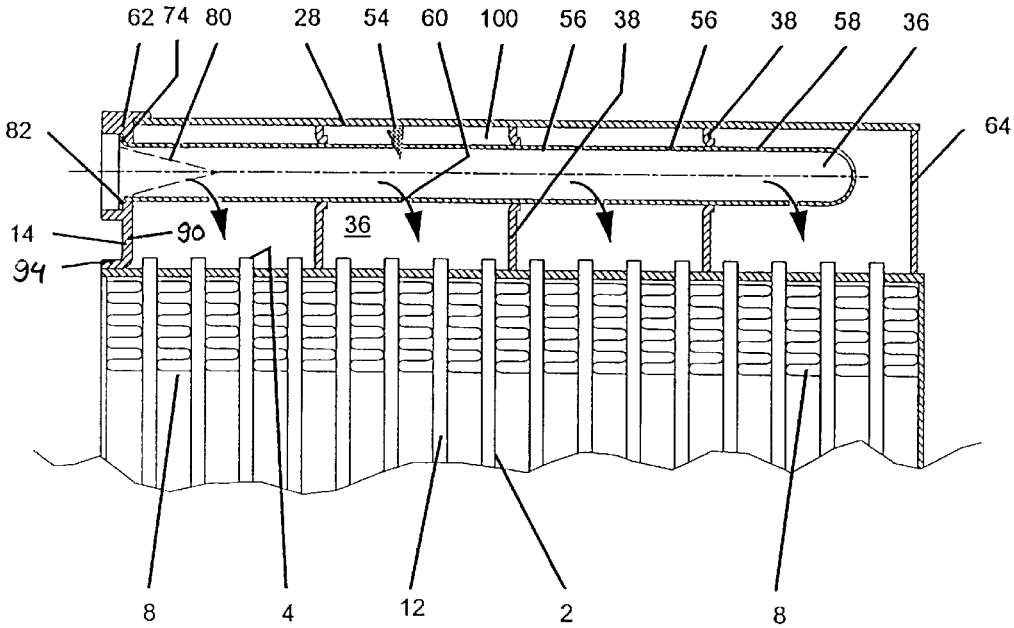
FIG. 4 shows a cross-section corresponding to FIG. 3 longitudinal of the whole case of a fourth embodiment of the same.

In the embodiments of FIGS. 3 and 4, the manifold 54 does not comprise a subdivision which partitions off own supply lines in the manifold to the inlet chambers 36, but it acts as a whole as a tubelike injection valve replacing the block valve 50 according to FIG. 2 for directly injecting the internal heat exchange fluid on the inlet side via the individual outlet openings 60 into the own inlet chambers 36 of the groups of flat tubes. The outlet openings are in this case conveniently adapted to the distribution task in the longitudinal direction of the manifold 54, with an optimization concerning the cross-section and optionally also concerning the geometry.

The case 18, at its periphery defined by the tube bottom 26 and the cap 28, has in its longitudinal direction a constant outer cross-section, except for some described particularities, and is terminated at the front side by an end piece 62 on the inlet side as well as by a further end piece 64 at the other front side, which can consist, like the tube bottom 26 in the embodiment of FIG. 4, of a solder-coated or braze-coated sheet metal and is then for example soldered or brazed between cap 28 and tube bottom 26 according to FIG. 4, or connected via a bent connection collar and a groove-and-tongue-connection to be soldered or brazed in a not shown manner. In the embodiment according to FIG. 5, the end piece 64 remote from the inlet is an integral component of the diecast piece forming the chamber subdivision 30 and is correspondingly integrally connected to the two longitudinal webs 32 and 40.

In the embodiment according to FIG. 5, furthermore the end piece 62 on the inlet side is also an integral component of the diecast piece of the chamber subdivision 30. Furthermore, plug-type connection means projecting to the outside of direct connection sleeves 48 for a thermostatically controlled block valve 50 (cf. FIG. 2) are integrally designed with the end piece 62 on the inlet side.

In the embodiment according to FIG. 2, the end piece 64 on the inlet side comprises an internal plug-type connection means 70 oriented in the longitudinal direction of the case 18 for the internal manifold 54 oriented therewith, while this manifold in case of the embodiments according to FIGS. 3 and 4 penetrates a central opening 76 of the end piece 64 partially in a plugged-in arrangement and contacts an external step 78 to the central opening 76 by a retaining collar 74 bent around in the form of a tulip. In this case, according to FIG. 3 the region of the manifold 54 plugged into the central opening 76 can be formed by an expanded end section 72 of the same, which then comprises the retaining collar 74.

If the manifold 54 is a direct injection manifold according to FIGS. 3 and 4 as illustrated, it conveniently comprises in the flow direction of the internal heat exchange fluid in front of the first outlet opening 60 an inserted sieve 80, which according to the drawn representation projects into the manifold 54, seen in the flow direction, pointed like a funnel, and is retained according to FIG. 3 at the step-like transition of the extended end section 72 into the rest of the manifold 54 and according to FIG. 4 at the retaining collar 74 with an expanded funnel edge 82.

According to FIG. 3 and in this sense in the similar arrangement according to FIG. 4, too, a supply tube 84 forming the supply line 14 engages the central opening 76 of the end piece 62 on the inlet side and is sealed with respect to the retaining collar 74 of the manifold 54 by an O-ring 86. An outer crimp 88 continuously extending around the supply tube 84 can here be retained between the outer front face of the end piece 62 on the inlet side and a flange 91 at the motor vehicle.

Here, according to FIG. 3 a projection 90 on the front side integral with the end piece 62 is inserted in a section set on edge 92 with a groove bottom with an engagement on two sides. In this arrangement and in that of FIG. 4, where the projection 90 comprises a base 94 bent to the outside, the whole cap 28 of the case together with the manifold 54 can be placed upon the tube bottom 26 and e.g. clinched with the tube bottom.

As the third and fourth embodiments according to FIGS. 3 and 4 show, which are comparable with respect to the kind of mounting the end piece 62 on the inlet side, the end piece 62 on the inlet side, here together with the cap 28, can be placed upon the tube bottom 26 in the direction of the flat tubes 2 and be connected therewith to form the case 18.

Similarly, the end piece 62 on the inlet side can be added to the front side of the case 18 from the outside crosswise to the extension direction of the flat tubes, i.e. in the longitudinal direction of the case 18, as is also the case in the kind of connection according to FIG. 2 realised in FIG. 1, i.e. in the first and the second embodiments.

The end piece 62 on the inlet side is moreover additionally utilized in the five embodiments.

With reference to FIGS. 2 and 5, it has already been pointed out that the end piece 62 on the inlet side has a plug-type connection, concretely spoken two outer connection sleeves 96 for the direct connection of a thermostatically controlled block valve 50. This valve can, e.g. according to FIG. 2, additionally be sealingly connected by means of a flange connection 98, sealing by means of an O-ring 86 arranged in an angle between the outer connection sleeve 96 and the flange of the flange connection 98. Mere plug-type or mere flange connections can also be selected.

It was also already illustrated by means of FIGS. 3 and 4, that the end piece 62 on the inlet side can also be combined instead of with the block valve 50 with a manifold 54 internally connected to the end piece 62 on the inlet side by means of a plug-type connection, which elongates the supply line 14 within the case or header and serves in the extension over the length of the case 18 as a direct injection valve into the own inlet chambers 36 of the groups of flat tubes 2.

The manifold 54 with the function of a direct injection valve can here, as well as the manifold 54 of the embodiment according to FIG. 2, which does not primarily serve as an injection valve, but can have, apart from the block valve 50, an additional injection function by a corresponding dimensioning of the outlet openings 60, slipped on an internal plug-type connection means 70 of the end piece 62 on the inlet side.

The arrangement according to FIGS. 3 and 4, in which the manifold 54 serving as direct injection valve grips through the central opening 76 of the end piece 62 on the inlet side at least partially, here even makes possible inserting the manifold 54 from the outside through the end piece 62 on the inlet side. In all embodiments of FIGS. 2 to 4, here the manifold 54 rests in a recess 100 each in the crosswise webs 38 of the chamber subdivision 30 and is, as mentioned, secured against axially shifting in the end piece 62 on the inlet side by means of the retaining collar 74.

Further essential functions of the end piece 62 on the inlet side are described in the following, wherein all mentioned functions can also be provided completely or partially in the other end piece 64 in a manner not shown.

In the first embodiment according to FIG. 1, the end piece 62 on the inlet side is designed and arranged such that on the side facing away from the heat exchange tubes 2 together with a projecting piece 102 integrally designed with the end piece 62 it leaves open a connection room 104 in the elongation of the flat tubes 2 on the front side, which are the first to be admitted by the heat exchange fluid, seen in the flow direction of the internal heat exchange fluid. In the corresponding representation in FIG. 1, the connection room 104 extends over the first two to three flat tubes of the first inlet chamber 36, seen in the flow direction of the internal heat exchange fluid. The projecting piece 102 reaching down to the plane of the side sheet metal 46, is approximately shaped as a lying S with a straight center limb, such that from the supply line 14 all tubes of the first inlet chamber 36, seen in the flow direction of the internal heat exchange fluid, can be provided with the internal heat exchange fluid through the related outlet opening 60.

The connection room 104 can be utilized in many respects. For example, in the narrow space in a motor vehicle it can be used for bending the supply line 14 within the assembling space provided for the complete evaporator and lead it out either laterally instead of the usual outlet on the front side of the case 18 or in elongation of the flat tubes 2 via a bent tube section which e.g. effects a deflection by 90°.

FIG. 2 shows a special utilization of this connection room 104 as assembly room for the thermostatically controlled block valve 50, which is nearly completely accomodated in the connection room 104 in the represented embodiment. Thereby, for the assembly of the block valve 50 no own space is required any longer and the supply line 14 can be connected at the outside to the block valve 50 via a flange connection 108, as if the block valve 50 would not exist at all, but the case 18 would be continued in the conventional construction up to the plane of the lateral side sheet 46.

The block valve 50 in turn can be screwed to the end piece 62, by at least one fastening bolt engaging with a screw thread engagement the pocket hole 15 provided with a corresponding thread, which contributes to the end piece 62 having the function of a link to externally (at the block valve 50) and optionally internally (manifold 54) continued lines.

What is claimed is:

1. A distributing/collecting case evaporator of a motor vehicle air conditioning equipment, said case comprises:

a tube bottom and a cap, the tube bottom and the cap having a constant external cross-section in the longitudinal extension direction between the case walls on the front side, wherein the tube bottom and the cap supplement each other at least in the direction of a narrow cross-section to the case, and have at least one, longitudinal partition in its longitudinal extension direction, and at least one case wall on the front side is formed by a separate end piece being in close contact to each adjacent longitudinal partition, wherein the at least one case wall is provided with the refrigerant inlet, and wherein a single end piece is arranged on at least one front side of the case in such a way that the refrigerant inlet as well as the refrigerant outlet extend through the end piece, and the end piece is simultaneously designed as a link to separate lines of the refrigerant inlet and the refrigerant outlet in which lines are continued externally and also internally, wherein the end piece is designed as a link for a manifold extending through the end piece.

2. A case according to claim 1, wherein the link is configured to externally attach to a block valve.

3. A case according to claim 1, wherein the end piece together with a projecting part leaves open a connection room in elongation on the front side of the space occupied by the heat exchange tubes of the evaporator and set back in the longitudinal direction of the case on the side facing away form the heat exchange tubes.

4. A case according to claim 3, wherein a block valve is arranged at least partially in the connection room.

5. A case according to claim 3, wherein the connection room receives lines continued outside the end piece with a bent design.

6. A case according to claim 4, wherein the connection room extends at least over the crosswise extension of one flat tube.

7. A case according to claim 3, in which a refrigerant is distributed to respective individual flat tubes or groups thereof via an inlet chamber, wherein the connection room extends over a length shorter than up to the partition separating the inlet chamber on the inlet side from the adjacent inlet chamber, and wherein the distribution opening of the refrigerant to the inlet chamber on the inlet side being arranged in the length difference.

8. A case according to claim 3, wherein the end piece is integrally designed with the projecting part and forms the complete boundary wall of the connection room.

9. A case according to claim 1, wherein the manifold is internally attached to the end piece.

10. A case according to claim 1, wherein the manifold grips through the end piece.

11. A case according to claim 1, wherein the end piece is an extruded piece.

12. A case according to claim 1, wherein the end piece is a diecast or an injection moulded piece.

13. A case according to claim 12, wherein at least one end piece forms an integral diecast or injection moulded piece with a compartment or chamber subdivision separately inserted between the tube bottom and cap.

14. A case according to claim 13, wherein the integral diecast or injection moulded piece additionally forms distribution ducts of the refrigerant on the inlet side to inlet chambers distributed in the longitudinal extension direction of the case and distributing the refrigerant into individual heat exchange tubes or groups thereof.

15. A case according to claim 1, wherein the lines of the refrigerant inlet and outlet continued internally.

16. A header of an evaporator of a vehicle air conditioning equipment comprising:

a housing with an opening in one side defining a longitudinal axis;

a longitudinal partition disposed inside the housing partitioning the housing into a plurality of subdivisions; and a separate case wall end piece disposed to block the opening of the housing and to contact the longitudinal partition, wherein the separate case wall end piece is designed as a link for a manifold extending through the end piece.

17. The case according to claim 16, wherein the housing comprises a tube bottom and a cap.

18. The case according to claim 17, wherein the tube bottom and the cap have a constant external cross-section between the case walls.

19. The case according to claim 16, wherein the case wall end piece is connected directly to an injection valve.

20. The case according to claim 16, wherein the case wall end piece is provided with a plurality of inlet and outlet ports.

21. The case according to claim 20, wherein the case wall end piece is a link which separates the inlet and outlet ports.

22. A header of an evaporator of a vehicle air conditioning equipment comprising:

means for defining a longitudinal axis by a housing with an opening;

means for partitioning the housing into a plurality of subdivisions by a longitudinal partition disposed inside the housing; and means for blocking the opening of the housing and for contacting the longitudinal partition by a separate case wall end piece, wherein the separate case wall end piece is designed as a link for a manifold extending through the end piece.

* * * * *